United States Patent [19]

Munther

[11] 4,277,893

[45] Jul. 14, 1981

[54] DRAWING INSTRUMENTS

[76] Inventor: Christian Munther, In den Schliermatten 6, 7813 Staufen, Fed. Rep. of Germany

[21] Appl. No.: 13,570

[22] Filed: Feb. 21, 1979

[30] Foreign Application Priority Data

Mar. 4, 1978 [DE] Fed. Rep. of Germany ..... 2809480

[51] Int. Cl.[3] ..... B43L 13/00

[52] U.S. Cl. ..... 33/18 R; 33/1 M

[58] Field of Search ..... 33/1 M, 18 R, 23 C; 346/29; 266/58

[56] References Cited

U.S. PATENT DOCUMENTS

| | | | |
|---|---|---|---|
| 2,751,273 | 6/1956 | Rankin | 33/18 R X |
| 3,439,425 | 4/1969 | Doxey et al. | 33/23 C |
| 3,696,397 | 10/1972 | Raser | 33/1 M |
| 3,726,019 | 4/1973 | Adler | 33/18 R X |

FOREIGN PATENT DOCUMENTS

| | | | |
|---|---|---|---|
| 1016038 | 1/1966 | United Kingdom . | |
| 1066170 | 4/1967 | United Kingdom . | |
| 1093146 | 11/1967 | United Kingdom | 33/18 R |
| 1097979 | 1/1968 | United Kingdom . | |
| 1126947 | 9/1968 | United Kingdom . | |
| 1155162 | 6/1969 | United Kingdom . | |
| 1162096 | 8/1969 | United Kingdom . | |
| 1165223 | 9/1969 | United Kingdom . | |
| 1210353 | 10/1970 | United Kingdom . | |
| 1367912 | 9/1974 | United Kingdom . | |
| 1399273 | 7/1975 | United Kingdom . | |

*Primary Examiner*—William D. Martin, Jr.

*Attorney, Agent, or Firm*—Buell, Blenko, Ziesenheim & Beck

[57] ABSTRACT

A self contained drawing instrument which is independent of external controls is provided in the form of a movable base with wheels for moving over a sheet, and carrying a scribing instrument, a drive motor for the wheels, a drive motor for the scribing instrument, a power source for the drive motors, a microprocessor and a programmable electronic calculator providing directions to the microprocessor connected together through an interface.

13 Claims, 8 Drawing Figures

DRAWING INSTRUMENTS

This invention relates to drawing instruments and particularly a portable motorized drawing instrument, controlled from a pocket calculator and capable of preparing drawings with a stylus on a writing pad.

Various forms of drawing instruments have, in the past, been proposed to assist and simplify the making of drawings on a drawing sheet. Basically, those instruments have been fixed instruments in which a sheet of paper to receive the drawing was fixed or clamped in the drawing instrument or on an associated surface or unrolled from a roll into and through the instrument.

In the present invention, there is provided a uniquely new approach to the problem of applying a drawing onto a sheet. The present invention provides a portable movable base, stylus and control means receiving a pocket calculator which base, control and calculator are capable of preparing drawings with the stylus on a writing pad or sheet.

In contrast to the conventional drawing instruments mentioned above, the paper, in the present invention, is not clamped in the drawing instrument or unrolled from a roll by the drawing instrument, but the drawing instrument itself moves back and forth on the sheet while making the drawing. Thus, drawings with dimensions larger than the drawing instrument can be prepared. In fact, the size of the drawing is not limited by the size of the instrument as in prior art devices but only by the size of the paper or drawing surface available.

This invention provides a drawing instrument which is unique in that it eliminates the need for continuous external direction or monitoring and is self contained. It is made up of a movable base having wheels for moving over a sheet, a drive motor on the base for driving the wheels, a motor driven scribing instrument on the base, a power source on the base for driving the motors, a microprocessor on the base for operating the drive and scribe motors and a programmable electronic calculator connected to the microprocessor through an interface and providing directions for the microprocessor. Preferably, the electronic calculator is a pocket calculator having an input keyboard for numerical information and one or more storage units. The drive means are preferably stepping motors. The control means is preferably a microprocessor and the connecting means an interface between the microprocessor and a calculator. Preferably, the transport means are wheels or endless tracks (caterpillar tracks) mounted on the base.

In the foregoing general outline of this invention certain objects, purposes and advantages have been set out. Other objects, purposes and advantages of this invention will be apparent from a consideration of the following description and the accompanying drawings in which.

Figure 1:
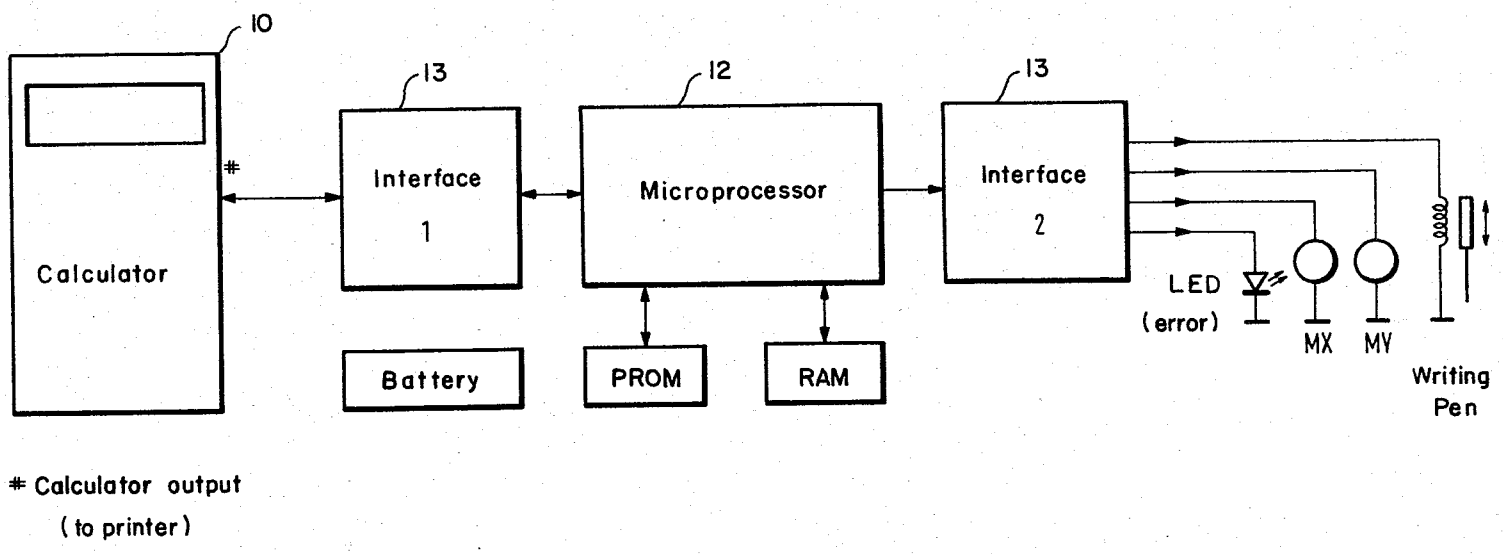
FIG. 1 is a block diagram of the apparatus of this invention.

Referring to the drawings and particularly FIG. 1, a block diagram of the apparatus of this invention is illustrated based upon the use of a programmable print out type pocket calculator.

Programmable pocket calculators usually have a printer outlet, through which a printer can be connected for printing alphameric characters. They also have detachable program modules that perform complex calculations, thus they can also contain plotter programs.

According to the invention, the pocket calculator 10 (FIG. 3) is placed on the moveable base or undercarriage 11. A microprocessor 12 of the undercarriage 11 is connected by an interface 13 to the printer outlet of the pocket calculator. FIG. 1 shows the block diagram of it. The microprocessor receives control sequences that are codified in the ASCII code through the interface 13. A command consists of two control letters that are followed by integral numbers (e.g., SX 5 100). The next command is then given by the pocket calculator only when the preceding one has been processed (feedback).

On the basis of the program in the PROM, the parameters fed in are either stored or converted immediately into step commands. The stepping motors, stylus lifter, and an indicator-LED are connected through a parallel 8-bit outlet. The coordinates of scales and points are transferred as whole positive numbers, which signify step numbers (e.g., 1. point: DX 15 DY 60, 2. point: DX 20 DY 80). The program sums all the X and Y changes and holds them in the storage; thus, the actual stylus position is always known to the microprocessor. If all the points are to be connected by a polygonal course, a sub-program "line" takes care that each new point given is connected with the preceding one by a suitable step sequence. Movement can thus be effected precisely in 8 directions; all the other directions are comprised of short polygonal courses.

The stylus is moved by the commands, "raise stylus" and "lower stylus". Excessive energy consumption is avoided by a mechanical bistable suspension of the stylus and by impulse stimulation.

Erroneous instructions of the pocket calculator are indicated by a signal lamp (LED). The current supply is from a rechargeable battery, possibly in conjunction with a battery charger.

Figure 2:
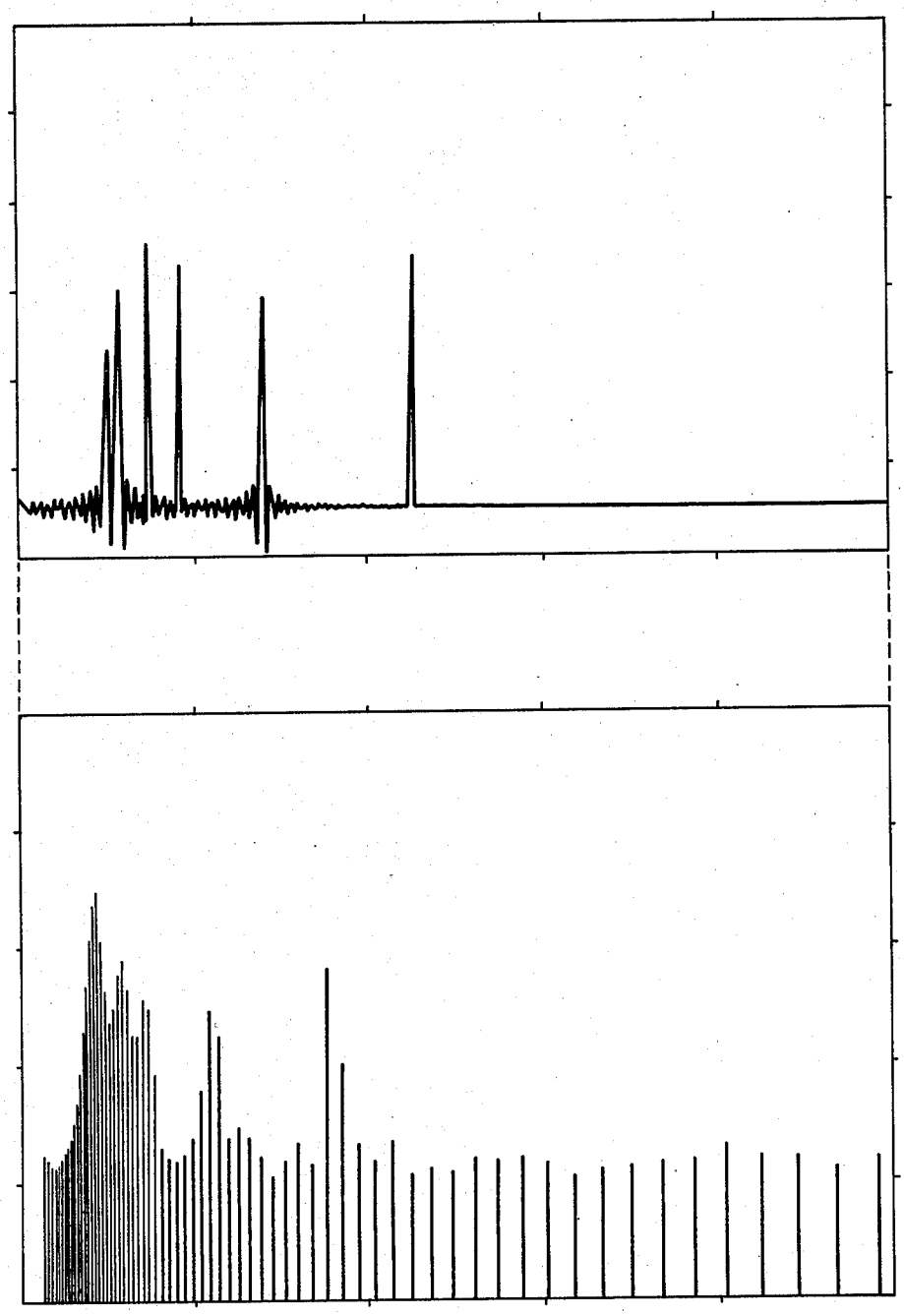
FIG. 2 illustrates two simulated drawings with scale.

The starting point on the drawing paper is in the X direction, where the pocket calculator stands during calibration. At this point in time, the Y stylus is also moved up to a lower stop. All the coordinate data furnished to the pocket calculator are positive. The origin of the coordinate axis is usually also shifted somewhat in the positive direction. The instrument moves to the right for any distance for increasing X; the stylus can be deflected upward by 10–15 cm for increasing Y. Two examples are given in FIG. 2.

Mechanical Structure

Figure 3:
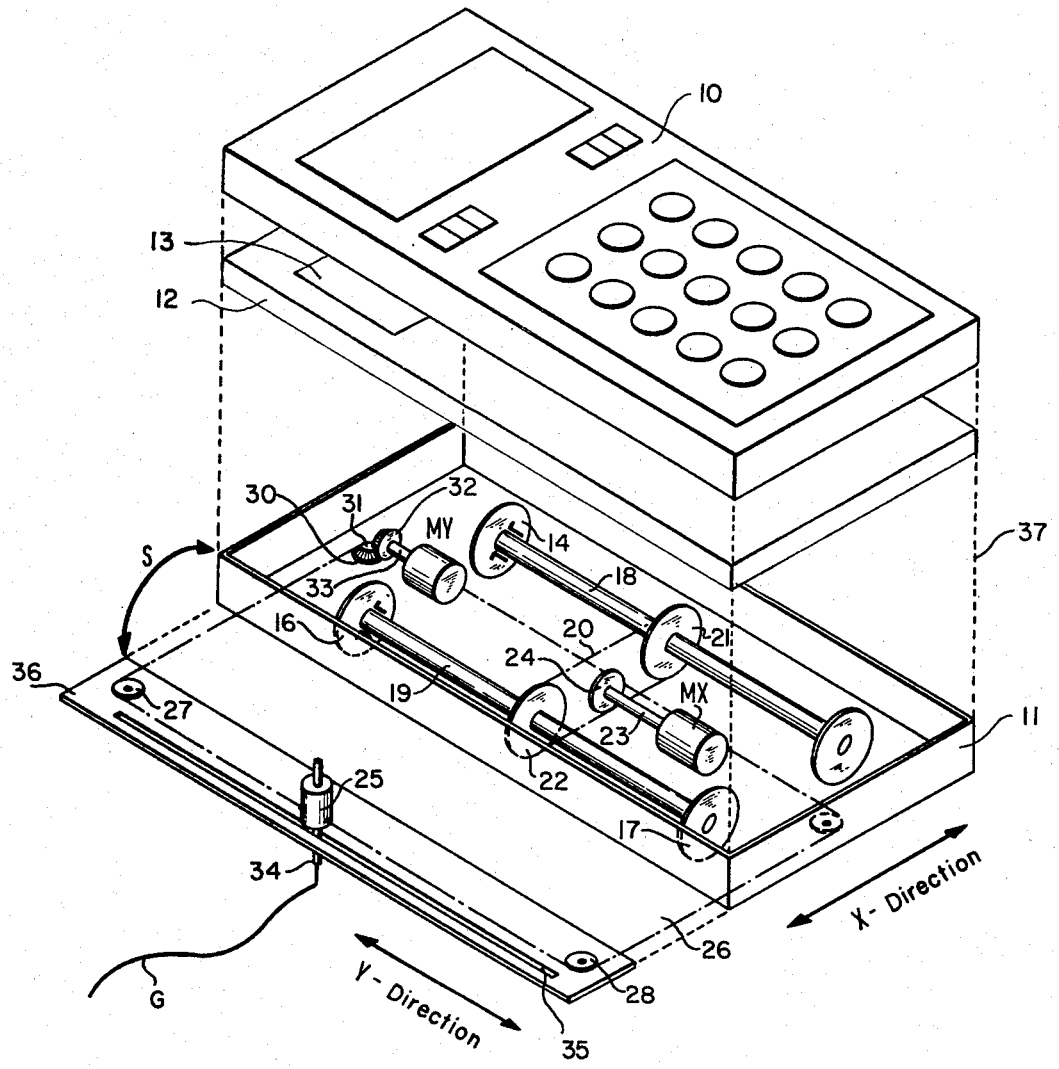
FIG. 3 is an exploded schematic illustration of a drawing instrument according to this invention.

In the drawing instrument shown in FIG. 3, the movable base 11 is fastened under the pocket calculator 10. The movable base 11 is provided with a transport means and a drive means for moving the movable base 11 over a drawing surface. The transport means comprises 4 wheels 14, 15, 16 and 17, which rest in operation of the drawing instrument on a drawing surface. In order to reduce the slippage between the wheels 14–17 and the drawing surface, the drawing instrument is driven by this 4 wheels 14–17 simultaneously. To this end there are provided two axles 18 and 19, and on each axle 18 and 19 there are fixed two wheels 14, 15 and 16, 17, respectively. The two axles 18, 19 are connected to each other by means of a cord 20 looped around rolls 21, 22 one of which is fixed to the axle 18 and the other of which is fixed to the axle 19. The drive means for the transport means comprises a stepping motor MX the output shaft 23 of which being connected by another roll 24 engaging the cord 20 with the two rolls 21, 22 for driving them to move the movable base 11 together with a writing head 25 by means of the wheels 14–17 over the drawing surface in the X direction.

The writing head 25 provided as scribing means to draw, e.g., a graph G is moved in the Y direction by a cord 26 that is looped around rolls 27, 28, 29 and 30. One of these rolls, i.e. the roll 30, is connected by two meshing bevel gears 31, 32 with the output shaft 33 of another stepping motor MY being the drive means for the scribing means. Thus, stepping motor MY drives the writing head 25 so that a stylus 34 runs in a guide slot or track 35 provided in a plate 36 arranged outside of a housing 37 containing the pocket calculator 10, the microprocessor 12 with the interface 13 and the movable base 11. The plate 36 equipped with the rolls 27, 28 serving also as guide rollers for guiding the cord 26 and thus the writing head 25 fixed thereto along the guide slot 35. The plate 36 can either be stationary or moved pivotally by an articulated joint (not shown) in the direction of the double headed arrow S. In the case of a rigid plate 36, i.e. when the stylus 34 cannot be lifted by pivotally moving the plate 36, a lifting mechanism (not shown) for lifting the stylus 34 is installed in the writing head 25. Such lifting mechanism can include a coil for drawing a magnet fixed to the stylus 34 upwardly if the coil is excited by an electric current. The current for excitation of the coil can be supplied through two steel cables (inside the instrument the cable is electrically interrupted, the inner guide rolls 29, 30 connect the two cable halves with a current source).

The torque of the Y motor is selected so that the individual X and Y steps take place uniformly in time. (After all, the X motor must move a greater mass than the Y motor).

Programming the Pocket Calculator

The plotter program is contained in a program module of the pocket calculator. It can be organized as the main program or as a subprogram (or as both).

Figure 4:
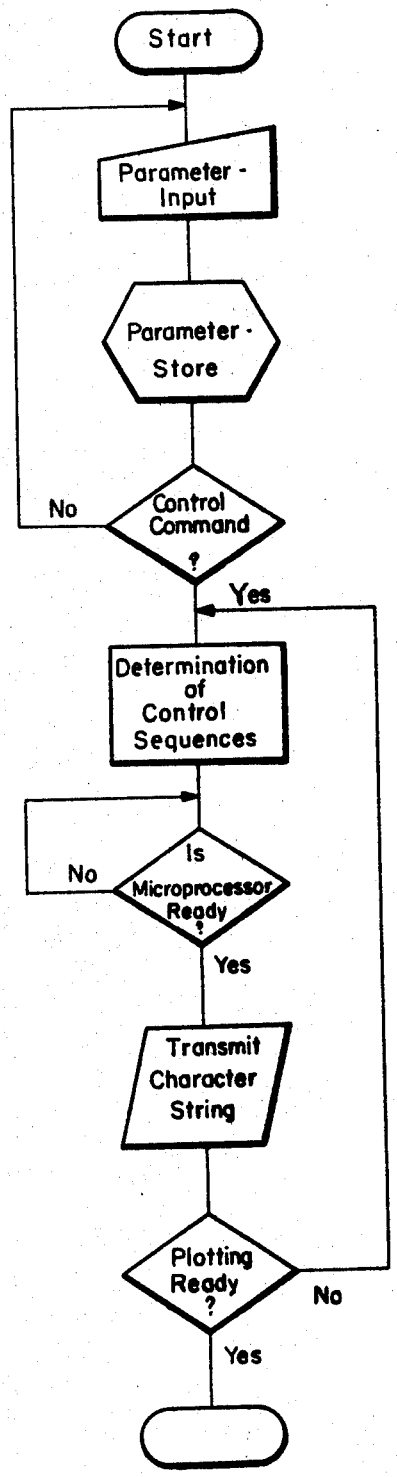
FIG. 4 is a program chart for preparing a drawing in the calculator portion of the apparatus of this invention.

If it is called as the main program, the following calls are necessary (FIG. 4):

1. Start of the plotter program, scaling, bringing up the Y zero point.
2. Indication of the scale factors.
3. Type of representation (lines, dashes, symbols).
4. Specification of the storage site or address where the point-coordinates to be represented are located, and how many there are.

After all the points have been plotted, the scale is plotted.

When used as a subroutine, the various subroutine calls are taken into the user program. First, the subroutines 1 . . . 3 (see above) are called. The points to be sketched are plotted as they occur in the calculation. If no other data follow, a subroutine "draw scale" is called and thereby the drawing is concluded.

In both variants the parameters and data transferred to the plotter program are checked: The scale data are examined for range transgression, the data points to be drawn are examined to see whether the coordinates fall into the range determined by the scale data or not.

The control commands are transferred in ASCII code through the interface between the pocket calculator and microprocessor:

| | | |
|---|---|---|
| Scale data for the X axis: | | |
| (TX) | SX Number of scale segments | Length of a segment (ETX) |
| e.g. | 5 | 60 |
| Transfer of an X coordinate: | | |
| (STX) | DX X coordinates (ETX) | |
| e.g. | 135 | |
| Draw scale: | | |
| (STX) SC (ETX) | | |
| without parameters (or with data for an axis designation) | | |

The special characters STX and ETX characterize the beginning and end of a command transfer. The individual symbols are stored and then worked up by the microprocessor and then stored in the storage. A feedback line indicates whether the particular command has been executed (waiting loop in the pocket calculator). All the coordinate data are given as step numbers. These whole numbers are calculated by the pocket calculator; they are a function of the desired discrimination, the drawing speed, and the speed reduction for the stepping motors.

Programming the Microprocessor

Figure 5:
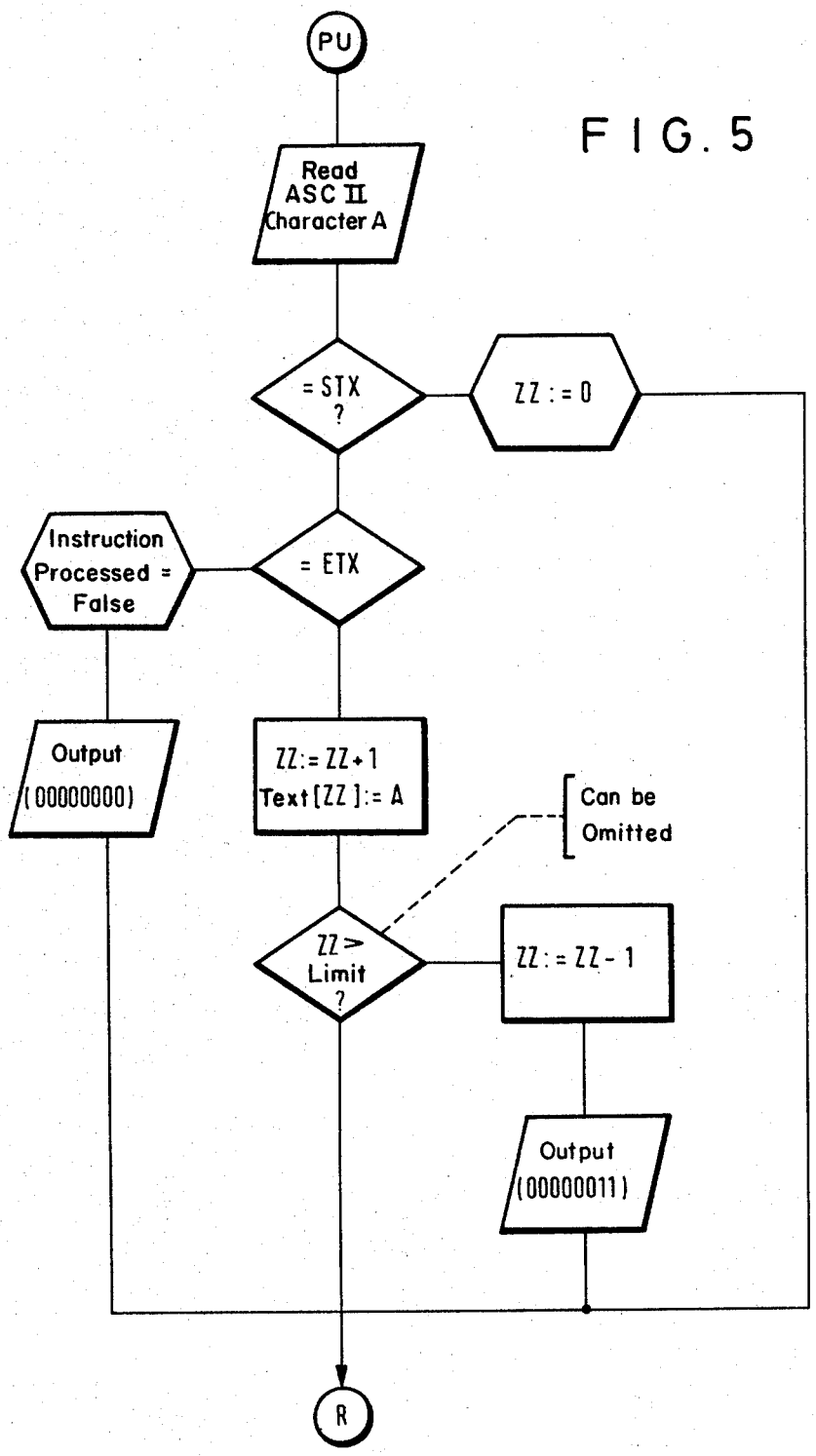
FIG. 5 is a simplified operational plan for program interruption in the microprocessor of this invention.

The microprocessor has an 8-bit input, a program interrupt circuit, and an 8-bit outlet. If the program interrupt is released, the pocket calculator can inscribe individual ASCII characters into the text synchronizer of the microprocessor (FIG. 5). The significance of the bits of the output word is as follows:

| −X | +X | −Y | +Y | −ST | +ST | FLR | RK |
|---|---|---|---|---|---|---|---|

A 1 signifies in the case of:
−X step in the −X direction
+X step in the +X direction
−Y step in the −Y direction
+Y step in the +Y direction
−ST raise stylus
+ST lower stylus
FLR LED on
RK processor ready, awaits further instructions "00000000" is outputted between the individual control statements in order to obtain pulse edges for controlling the motor driver.

Figure 6:
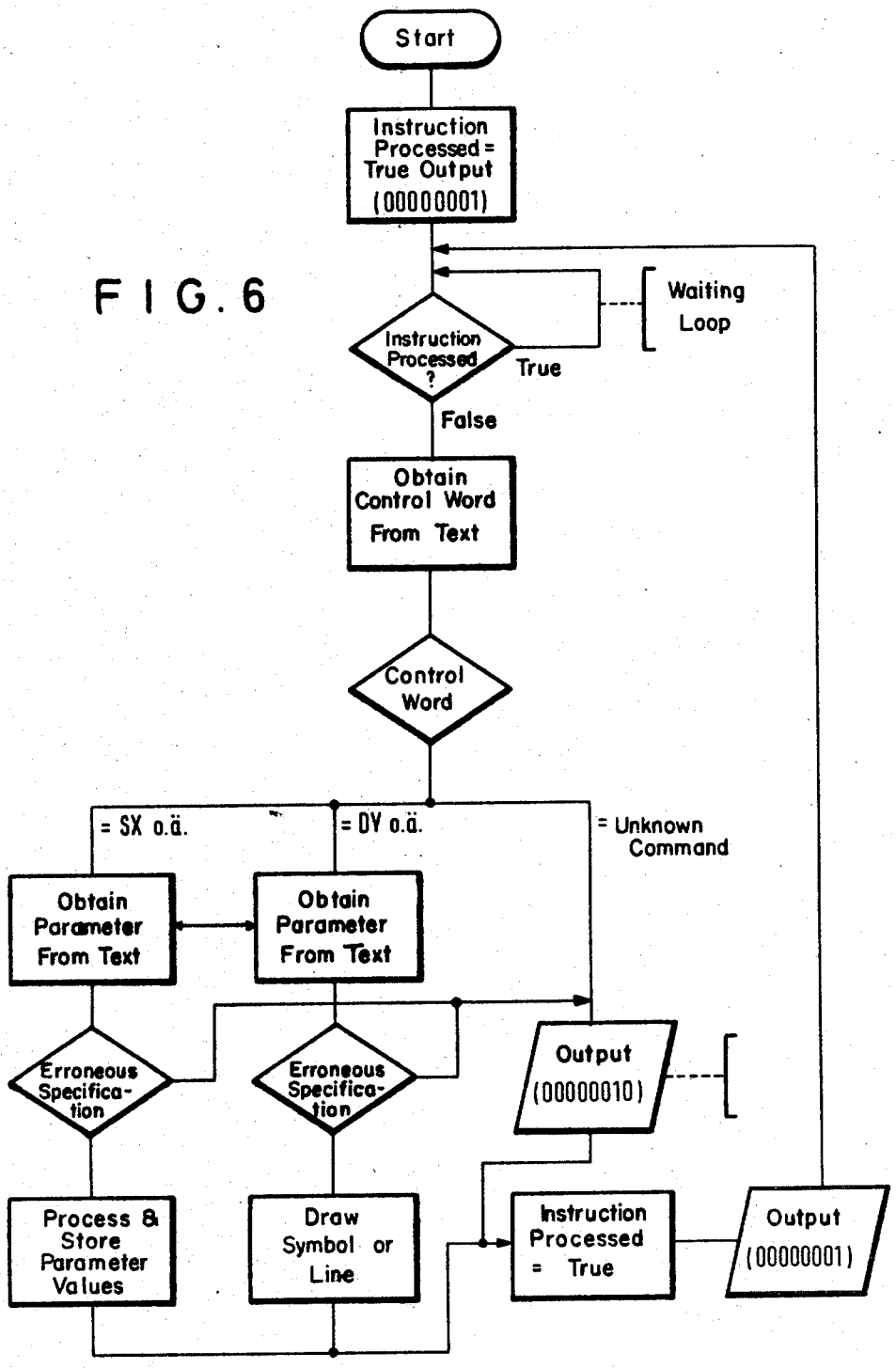
FIG. 6 is a simplified operational program for the microprocessor.

FIG. 6 shows the simplified program flow chart. After switching on, the microprocessor goes into a waiting loop until there is a completely terminated control statement in the text buffer. Then this statement is processed. There are two types here: those that furnish the parameters and others that lead immediately to motor movements. Only when the microprocessor has processed the last statement is "00000001" transmitted; the pocket calculator is thus informed that the next statement is expected.

The interfaces to the stepping motors for the stylus lifter and the indicator lamp consist essentially of amplifiers that prepare the required drive power.

Other Alternative Mechanical Details

Figure 7:
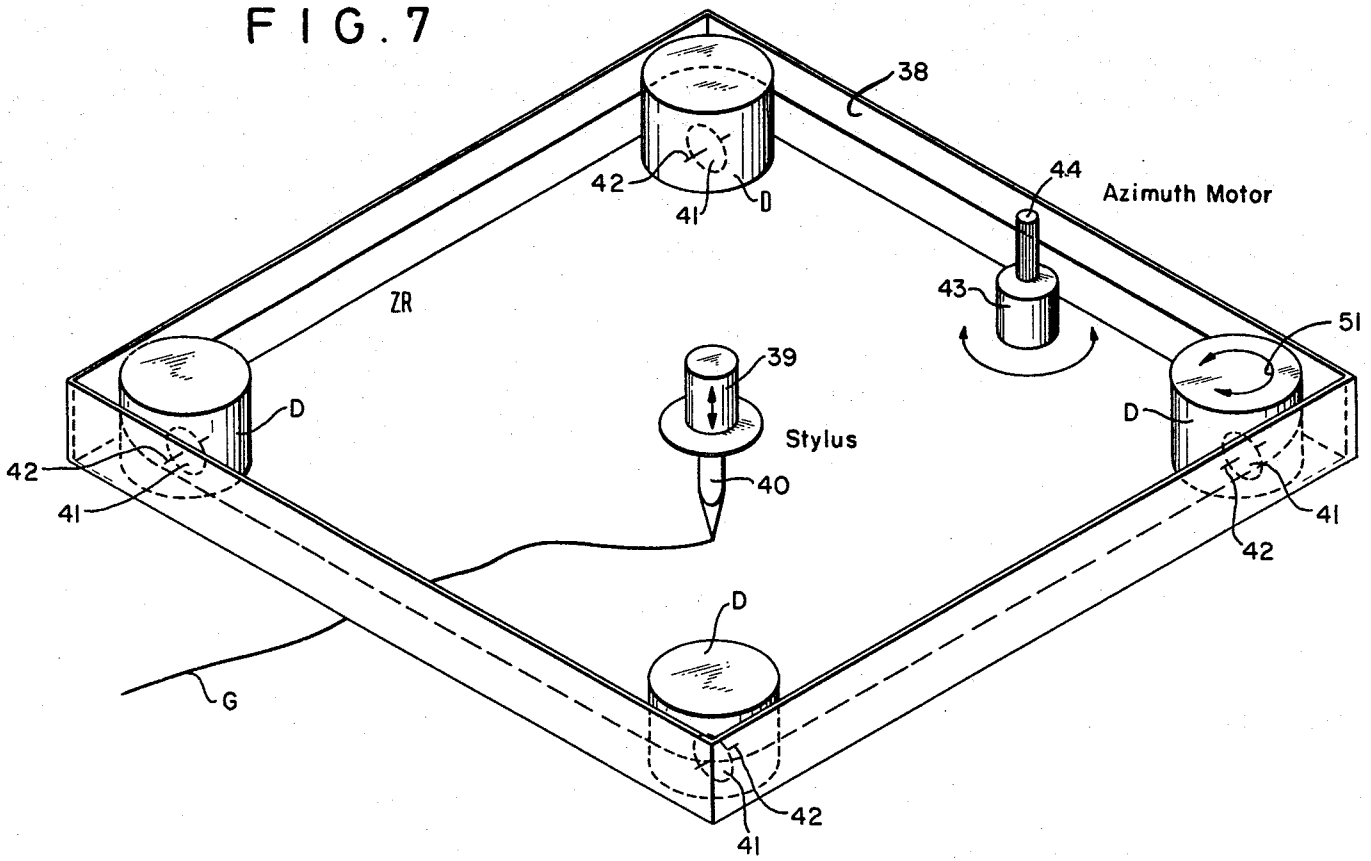
FIG. 7 is a schematic isometric view of the second embodiment of drive arrangement used in this invention.
Figure 8:
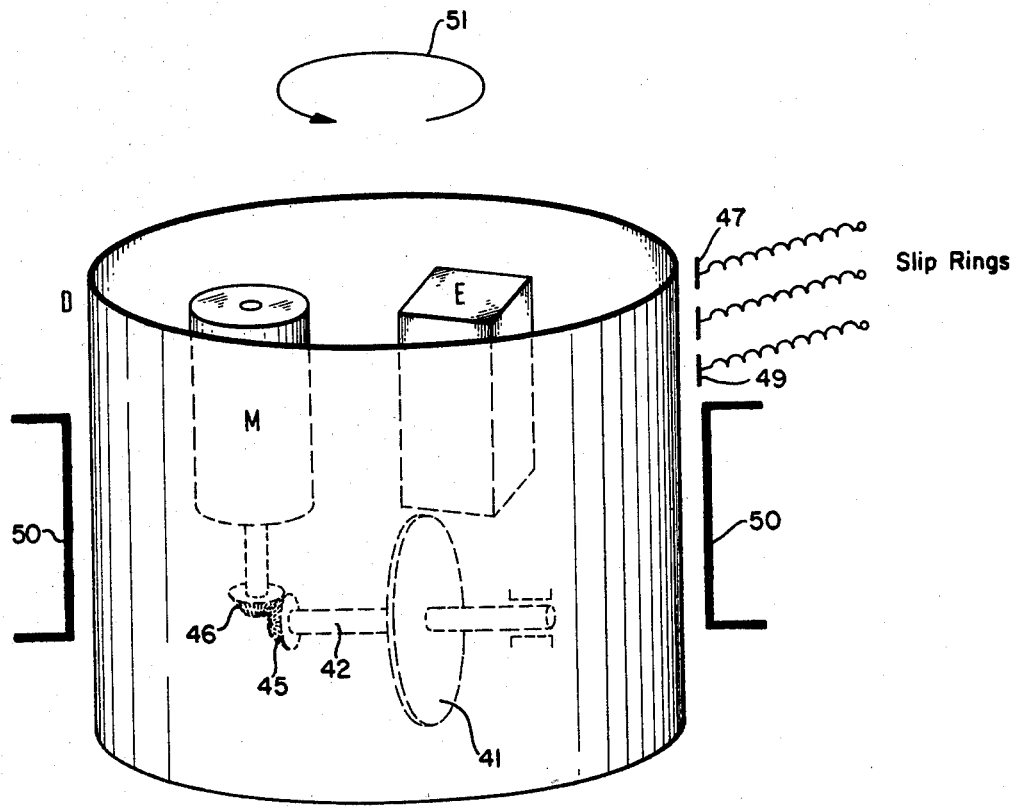
FIG. 8 is an enlarged schematic isometric view of drive unit according to FIG. 7.

While the deflection in the Y direction is limited in the model described up to this point, a drawing instrument according to FIGS. 7 and 8 can move to any distance in any direction.

FIGS. 7 and 8 illustrate only the movable base 38 with a writing head 39 having a stylus 40 and details of such movable base. The remaining construction of the drawing instrument being same as in FIG. 3.

A drawing instrument having a movable base 38 according to FIGS. 7 and 8 includes a transport means which comprises four wheels 41 resting in operation of the drawing instrument on a drawing surface on which the stylus 40 draws a graph G upon movement of the movable base 38 over the drawing surface caused by the wheels 41. The axles 42 of the wheels 41 are rotated jointly and azimuthally in that they are connected to each other and to a stepping motor 43 by means of a toothed belt ZR meshing with a gear 44 on the output shaft of the motor 43. The stylus 40 is located precisely at the midpoint between the four wheels 41. Each of the drive wheels 41 is installed in a container D. Thus, the horizontal directions of the axles 42 are adjustable by the stepping motor 43.

As transport drive means there is provided for each wheel 41 a drive motor M (see FIG. 8). At 50 there is indicated a bearing in which the container D is rotatably (see arrow 51) supported in the movable base 38. The wheel axle 42 is connected with the drive motor M through a gear unit comprising two bevel gears 45, 46. The current for driving the motor M is supplied over three slip rings 47, 48, 49. One of them transfers the information on the forward and backward course of the motor M (an optoelectronic coupling is also possible instead of this slip ring). An interface E processes the impulse arriving over a control circuit and switches the stepping motor M on.

The actual position of the stylus 40 is known to the microprocessor 12 (see FIGS. 1 and 3) through the fact that the changes in the X and Y directions that occur due to movements in the present polar coordinate system are also summed and stored.

The programming of the pocket calculator and the microprocessor in the embodiment of FIGS. 7 and 8 is similar to that described above.

In the foregoing specification, certain preferred embodiments and practices of this invention have been set out, however, it will be understood that this invention may be otherwise embodied within the scope of the following claims.

I claim:

1. A drawing instrument comprising a movable base, transport means on said base, transport drive means for driving said transport means over a sheet, scribing means on said base, scribe driving means for moving said scribing means on said base, control means for controlling selectively said transport drive means and said scribe drive means, an electronic calculator and connection means between said electronic calculator and said control means, said control means and said electronic calculator as well as said connection means being arranged on and moving with said base, and a current supply for said drawing instrument on said base, whereby said instrument is self contained and is a unitary independent mechanism independent of external controls.

2. A drawing instrument as claimed in claim 1 wherein the transport means are wheels.

3. A drawing instrument as claimed in claim 1 wherein the scribe drive means raises and lowers the scribing means.

4. A drawing instrument as claimed in claim 1 wherein the scribe drive means selectively raises and lowers the scribing means and transports the scribing means transversely of the base.

5. A drawing instrument as claimed in claim 1, 2, 3 or 4 wherein the calculator is a programmable pocket calculator.

6. A drawing instrument as claimed in claim 1, 2, 3 or 4 wherein the transport drive means and scribe drive means are stepping motors.

7. A drawing instrument as claimed in claim 1, 2, 3 or 4 wherein the control means is a microprocessor.

8. A drawing instrument as claimed in claim 1 wherein the scribing means is a stylus.

9. A drawing instrument as claimed in claim 8 wherein the stylus is moved by a telescoping arm on the base.

10. A drawing instrument as claimed in claim 8 wherein the stylus is movable along a track on the base.

11. A drawing instrument as claimed in claim 2 wherein the axes of all wheels are rotatable jointly and azimuthally to adjust their horizontal position.

12. A drawing instrument as defined in claim 11, characterized in that each of the wheels is installed in a container being engaged by a common toothed belt which itself is engaged by a stepping motor.

13. A drawing instrument as claimed in claim 1 wherein the current supply is a battery.

* * * * *

UNITED STATES PATENT AND TRADEMARK OFFICE

CERTIFICATE OF CORRECTION

PATENT NO. : 4,277,893

DATED : July 14, 1981

INVENTOR(S) : CHRISTIAN MUNTHER

It is certified that error appears in the above-identified patent and that said Letters Patent are hereby corrected as shown below:

Claim 1, column 6, lines 10-18 inclusive should read as follows:

"said scribe drive means, a programmable electronic calculator providing the directions for movement to said control means for an entire drawing and interface means connecting said electronic calculator and said control means, said control means and said electronic calculator as well as said interface means being arranged on and moving with said base, and a current supply for said drawing instrument on said base, whereby said instrument is self contained and is a unitary independent mechanism independent of external controls."

Signed and Sealed this

*Twenty-seventh* Day of *October 1981*

[SEAL]

*Attest:*

GERALD J. MOSSINGHOFF

*Attesting Officer*

*Commissioner of Patents and Trademarks*